US008256852B2

(12) United States Patent
Machala et al.

(10) Patent No.: US 8,256,852 B2
(45) **Date of Patent: *Sep. 4, 2012**

(54) CLOTHING AND TEXTILE SYSTEM

(75) Inventors: Paul J. Machala, Kalamazoo, MI (US); Daniel C. Mehren, Richland, MI (US)

(73) Assignee: Borroughs Corporation, Kalamazoo, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/168,406

(22) Filed: Jun. 24, 2011

(65) Prior Publication Data

US 2011/0253654 A1 Oct. 20, 2011

Related U.S. Application Data

(62) Division of application No. 11/789,975, filed on Apr. 26, 2007, now Pat. No. 7,988,245.

(60) Provisional application No. 60/796,237, filed on Apr. 28, 2006.

(51) Int. Cl.
*A47B 88/00* (2006.01)

(52) U.S. Cl. ..... 312/330.1; 206/557

(58) Field of Classification Search ..... 206/557; 312/330.1, 348.1, 348.3, 348.5, 183, 184, 312/408, 410, 351, 265.1, 265.2, 265.3, 283, 312/286, 265.4, 334.13; 108/108, 161, 180, 108/181; 211/94.02, 126.15, 134, 135, 85.3, 211/126.1; 220/495.11

See application file for complete search history.

(56) References Cited

U.S. PATENT DOCUMENTS

| | | | | |
|---|---|---|---|---|
| 960,342 | A | | 6/1910 | Kleckner |
| 984,823 | A | | 2/1911 | Linden |
| 1,219,624 | A | | 3/1917 | Cannan |
| 1,272,819 | A | | 7/1918 | Linnett |
| 1,637,206 | A | | 7/1927 | Weeks |
| 1,918,634 | A | * | 7/1933 | Cordes ..... 211/1 |
| 2,011,125 | A | * | 8/1935 | Small ..... 126/40 |
| 2,241,053 | A | * | 5/1941 | Brightman ..... 62/333 |
| 2,343,692 | A | * | 3/1944 | Miller ..... 312/334.13 |
| 2,528,358 | A | | 10/1950 | Grass |
| 2,565,784 | A | | 8/1951 | Sheean |
| 2,780,510 | A | * | 2/1957 | Cole, Jr. ..... 312/334.13 |
| 2,983,232 | A | | 5/1961 | Henrikson |
| 3,241,500 | A | | 3/1966 | Barclay et al. |
| 3,278,149 | A | | 10/1966 | Brucker |
| 3,729,242 | A | | 4/1973 | Barney |
| 4,411,300 | A | | 10/1983 | Rico |
| 4,588,096 | A | | 5/1986 | Story et al. |
| 4,726,635 | A | | 2/1988 | Rariden et al. |
| 4,745,644 | A | | 5/1988 | Pottschmidt |
| 4,905,836 | A | * | 3/1990 | Lindgren et al. ..... 206/557 |
| 5,016,527 | A | | 5/1991 | Spamer et al. |
| 5,022,541 | A | | 6/1991 | White |
| 5,044,704 | A | * | 9/1991 | Bussan et al. ..... 312/402 |
| 5,641,093 | A | | 6/1997 | Dolin et al. |
| 5,677,030 | A | | 10/1997 | Shanok et al. |
| D393,512 | S | | 4/1998 | Van de Oudeweetering |

(Continued)

*Primary Examiner* — James O Hansen

(74) *Attorney, Agent, or Firm* — Gardner, Linn, Burkhart & Flory, LLP

(57) ABSTRACT

A tray for supporting clothing, textiles, or other delicate articles includes a frame and an inert liner located in the frame. Further, the frame may include guides for sliding engagement with the rails. Optionally, a storage system includes a pair of rails for supporting the tray. The rails permit unrestricted sliding movement of the tray so that the tray can be moved in opposed directions and removed or inserted from either side of the storage system.

22 Claims, 13 Drawing Sheets

U.S. PATENT DOCUMENTS

| | | | |
|---|---|---|---|
| 5,873,642 | A | 2/1999 | Domenig |
| 5,947,574 | A | 9/1999 | Avendano |
| 6,045,101 | A | 4/2000 | Goyette et al. |
| 6,086,176 | A | 7/2000 | Aoyama |
| 6,105,233 | A | 8/2000 | Neal |
| 6,409,292 | B1 | 6/2002 | Janowitz |
| 6,550,874 | B2 | 4/2003 | Walla et al. |
| 6,663,202 | B2 | 12/2003 | Spann |
| 6,729,704 | B2 | 5/2004 | Ames |
| 6,811,045 | B1 | 11/2004 | Masker et al. |
| 6,923,519 | B2 | 8/2005 | Dallman et al. |
| 6,935,519 | B2 | 8/2005 | Lawson et al. |
| 6,974,042 | B2 | 12/2005 | Hall |
| 7,350,885 | B2 | 4/2008 | Bodingbauer |
| 7,428,976 | B2 | 9/2008 | Cheng et al. |
| 2002/0040564 | A1 | 4/2002 | Killingbeck et al. |
| 2003/0094143 | A1 | 5/2003 | Anderson |
| 2006/0145577 | A1 | 7/2006 | Daley et al. |

* cited by examiner

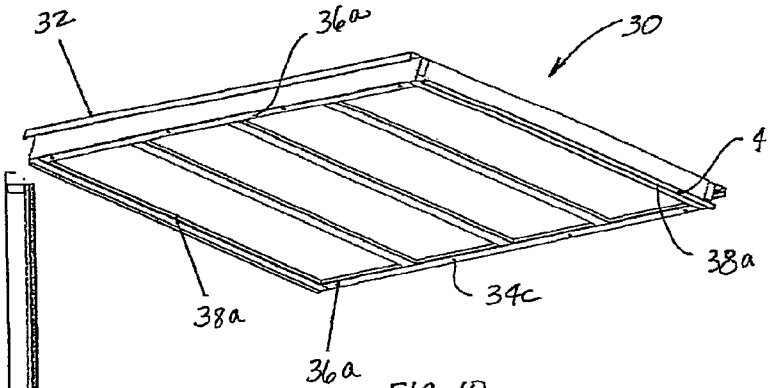
FIG. 10
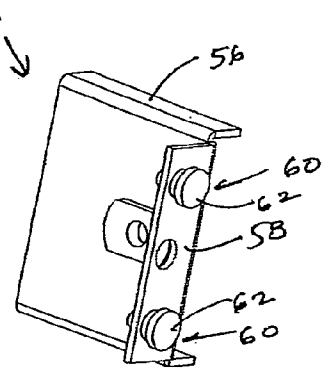
FIG. 8A
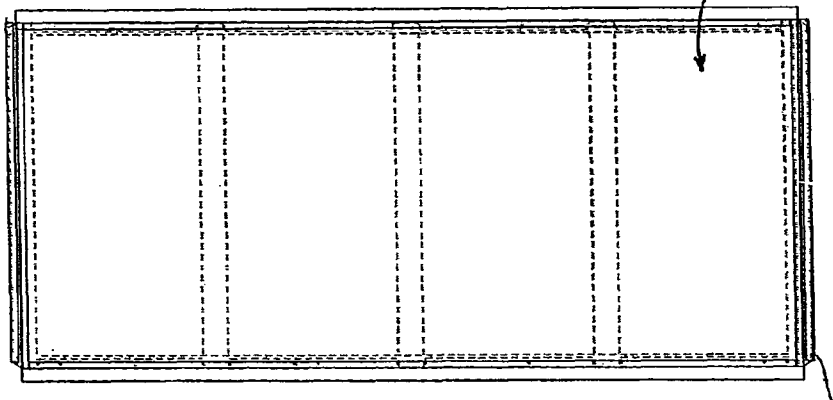
FIG. 13
FIG. 12
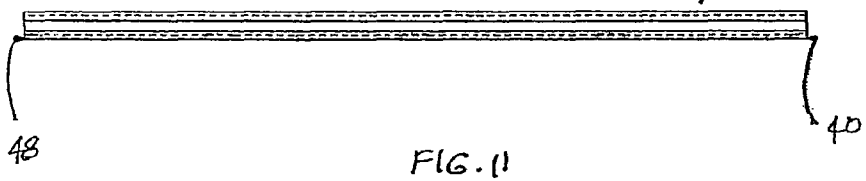
FIG. 11

XXII

46

66

66
46
44
36

46
XXIII
36
40
40
66
36b
36a
38b
38a
46
38
66
32

XXI
46
66
36
44

CLOTHING AND TEXTILE SYSTEM

CROSS REFERENCE TO RELATED APPLICATIONS

This application is a divisional of U.S. patent application Ser. No. 11/789,975, filed Apr. 26, 2007, now U.S. Pat. No. 7,988,245 which claims priority from U.S. provisional application Ser. No. 60/796,237, filed Apr. 28, 2006, which are hereby incorporated by reference herein in their entireties.

TECHNICAL FIELD AND BACKGROUND OF THE INVENTION

The present invention generally relates to a storage system and, more particular, to a storage system that is suitable for storing textiles, including clothing, fabrics, and other delicate items.

SUMMARY OF THE INVENTION

The present invention relates to a storage system and its several components that allow various textiles, such as clothing, fabrics, or other delicate items to be organized and supported in a manner to protect the textiles.

In one form of the invention, a tray, which is suitable for mounting in a stationary shelf or "upright" or in a shelving system, includes a frame and an inert liner. The tray further includes guides for sliding engagement by a pair of rails, which then mount the tray in a shelf or shelving system.

In one aspect, the inert liner is formed form an inert plastic, such as a high impact polypropylene copolymer. For example, a suitable polypropylene copolymer is available under the trademark COROPLAST, which is a corrugated plastic that has an NILH pH factor.

In another aspect, the tray includes a pair of guides and is supported by two rails, with each rail including a channel-shaped member that is adapted to mount in a shelf or shelving system and a track for receiving the guides of the tray. For example, the channel-shaped member may include an intermediate projecting flange and a lower flange, which define the track therebetween.

According to another form of the invention, a drawer, which is also adapted to mount in a shelf or in a shelving system, includes a perimeter frame. The frame includes first and second pairs of opposed sides, with each of the first pair of opposed sides including an upper flange with a plurality of cooperative structures that define a plurality of defined positions along the first pair of opposed sides. Further, the drawer includes at least two brackets with each bracket being supported on the first pair of opposed sides and, further, including at least one cooperative structure for engaging the cooperative structures on the upper flanges of the first pair of opposed sides to provide fixed, defined locations for the brackets along the first pair of opposed sides. Further, extended between the brackets is a rod for hanging objects from the frame.

In one aspect, the upper flanges of the first pair of opposed sides of the frame includes a plurality of openings, and each of the brackets includes at least one projection for engaging a selected opening of the plurality of openings. In a further aspect, the bracket includes a pair of projecting structures for engaging two of the openings to thereby longitudinal fix the position of the brackets along the first pair of sides.

In another aspect, each of the opposed sides of the frame include an inwardly projecting lip for supporting the brackets.

In a further aspect, the rod is releasable supported in the respective brackets. For example, each of the brackets may include a cradle for supporting an end portion of the rod.

In a further aspect, the drawer engages a pair of slide rails for mounting the drawer in a shelf or shelving system.

According to another form of the invention, a shelf includes a base and a pair of upwardly extending side panels, which are interconnected at their upper ends by a generally horizontal panel. Mounted to the side panels are vertical rails with cooperative structures for engagement by horizontal rails that may be selectively positioned in the shelf. At least two of the horizontal rails are positioned on opposed sides of the shelf and with each rail having a cradle for supporting a rod that extends between the opposed rails.

For example, the opposed rails may include a generally J-shaped bracket with first and second legs, with the first leg mounted to the rail and the second leg spaced from the first leg and forming the cradle.

Accordingly, the present invention provides a system and components that are particular suitable for supporting and storing textiles, which can either be laid in the trays of the present invention or suspended from the rods that are provided by the components of the present invention.

These and other objects, features and advantages of the present invention will be more readily apparent from the detailed description of the preferred embodiments set forth below, taken in conjunction with the accompanying drawings.

BRIEF DESCRIPTION OF THE DRAWINGS

FIG. 8A is a perspective view of a mounting bracket of FIG. 8;

FIG. 10 is a perspective view of a tray of the present invention;

FIG. 11 is a front elevation view of the tray of FIG. 10;

FIG. 12 is a top plan view of the tray of FIG. 11;

FIG. 13 is a side elevation view of the tray of FIG. 12;

DETAILED DESCRIPTION OF THE PREFERRED EMBODIMENTS

Figure 1:
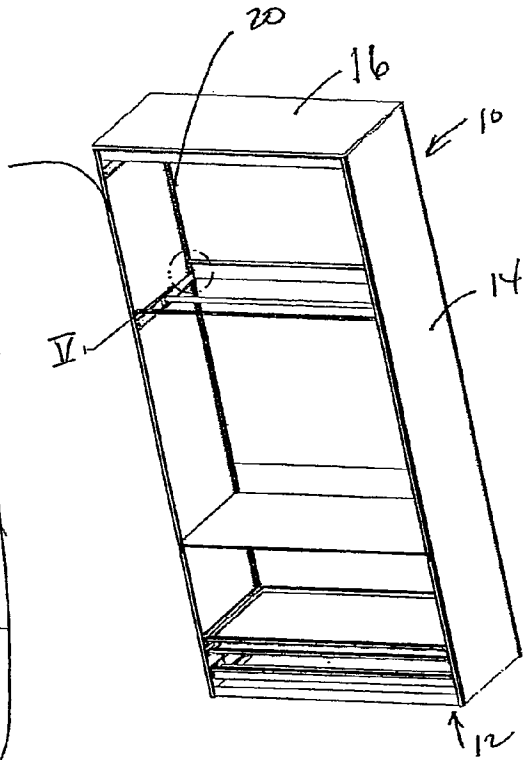
FIG. 1 is a perspective view of a shelf of the present invention.

Referring to FIG. 1, the numeral 10 generally designates a shelf of the present invention. Although illustrated as a single upright stationary shelf, otherwise known as an "upright" in the shelving industry, it will be appreciated from the following description that the components of the present invention may be incorporated into a shelving system, including a shelving system that incorporates movable shelf units. As will be more fully described below, shelf 10 incorporates one or more components that facilitate the storage of textiles, such as clothing, fabrics, or other delicate items and, further, stores them in a manner to make them more easily accessible and, further, with some components providing protection from chemical impregnation that may occur when using conventional components.

Figure 5:
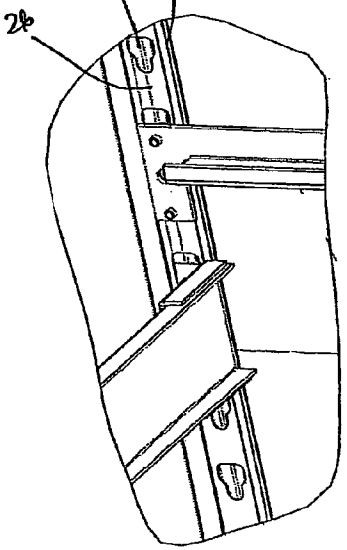
FIG. 5 is an enlarged detailed view of detail V of FIG. 1.
Figure 3:
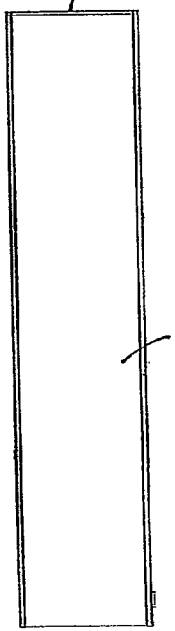
FIG. 3 is a side elevation view of the shelf of FIG. 1.
Figure 4:
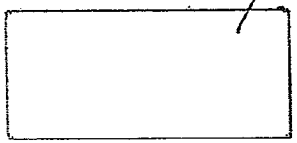
FIG. 4 is a plan view of the shelf of FIG. 1.
Figure 2:
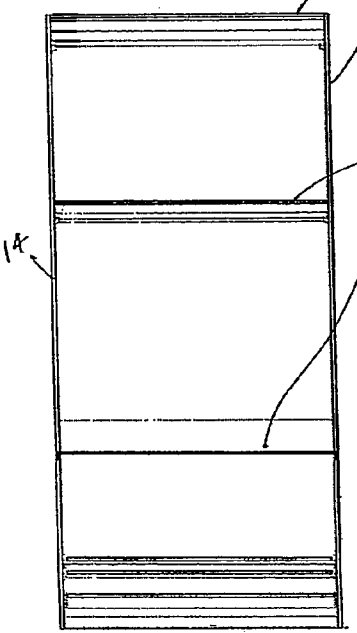
FIG. 2 is a front elevation view of the shelf of FIG. 1.
Figure 6:
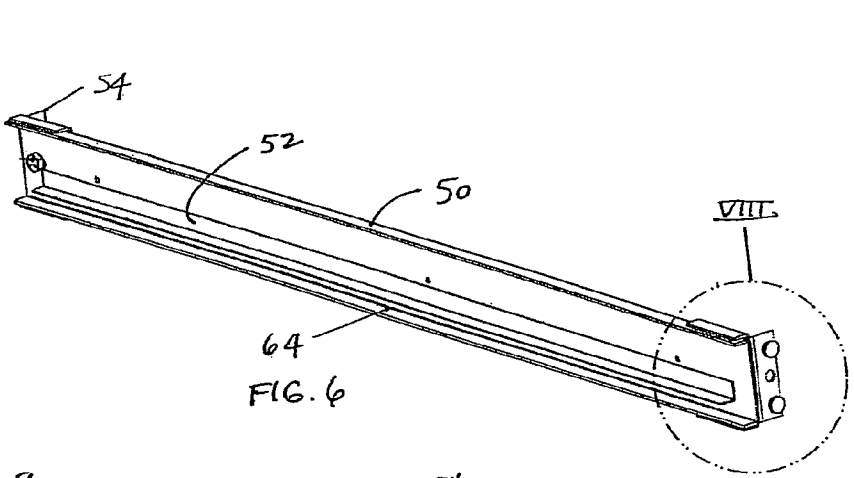
FIG. 6 is a perspective view of a tray channel and mounting brackets.

Shelf 10 includes a base 12 and a pair of vertical side panels 14 that are connected at their upper ends by a horizontal panel 16. Panels 14 and 16 are conventional and are formed from thin sheet metal that is mounted to frame members, which provide rigidity to their respective panels. Mounted at or near the edges of panels 14 are vertical rails 20, 22, which provide mounting surfaces for the several components that may be mounted in shelf 10, as will be more fully described below. In addition, panels 14 are braced by horizontal supports or rails (FIGS. 1 and 5) which are mounted in the vertical rails using conventional hardware. Further, shelf 10 optionally includes one or more shelf elements 18 that are mounted between the respective vertical panels. Preferably, shelf elements 18 are removable and are mounted to vertical rails 20 and 22 using conventional hardware. The horizontal supports, shelf elements 18, and their respective mounting hardware are conventional and commercially available from Borroughs Corporation of Kalamazoo Mich.; therefore, no further details of these components will be provided herein.

Rails 20, 22 are also conventional and are typically channel-shaped rails with mounting openings 24, such as keyhole-shaped openings, provided in their webs 26 for engagement by brackets, which include pins with enlarged heads. The pins extend into the opening and when lowered in the opening secure the respective shelf elements to the rails in a similar manner to that desired in reference to the other components described in more detail below.

Figure 9:
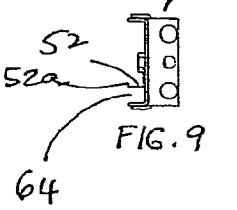
FIG. 9 is an end view of the tray channel and mounting bracket of FIG. 7.
Figure 7:
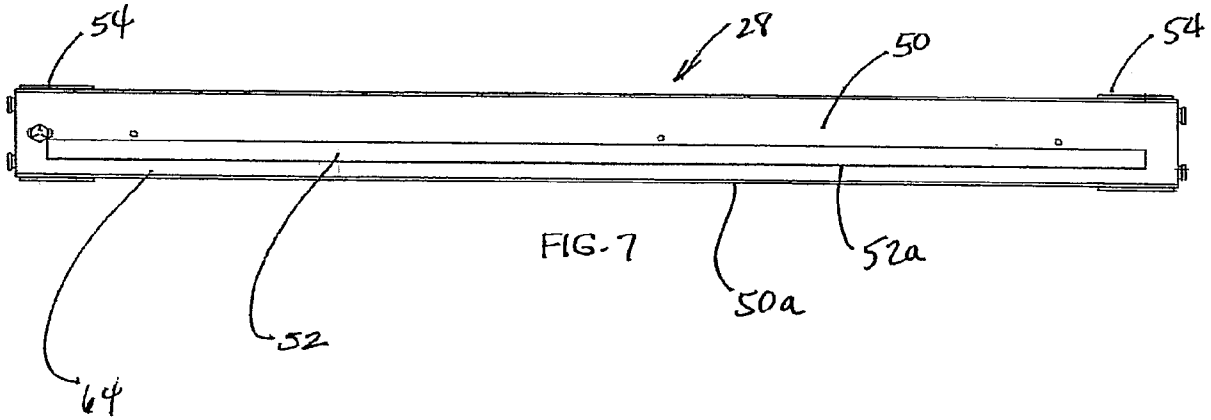
FIG. 7 is an elevation view of the tray channel and mounting bracket of FIG. 6.
Figure 8:
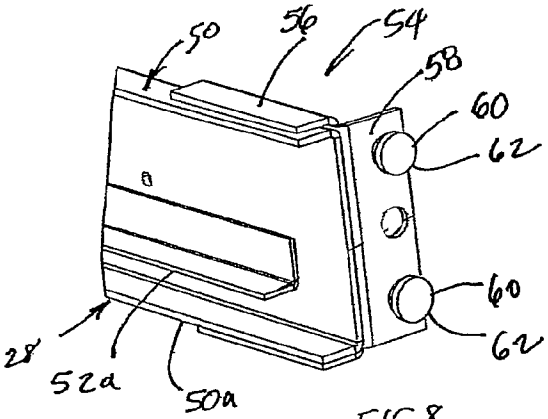
FIG. 8 is an enlarged view of detail VIII of FIG. 6.

As previously noted, shelf 10 may incorporate one or more components that are configured and arranged to facilitate handling of textile products, including clothing, fabric, or the like. Referring to FIGS. 7-9, optionally mounted between vertical rails 20, 22 are a pair of horizontal rails or tray channels 28. Each tray channel 28 may be used as a left-hand or right-hand side tray channel or may be constructed with mirror image to provide left or right-hand tray channels. But in order to take advantage of economies of scale and to reduce cost and inventory, it may be preferable to provide a tray channel that can be used as both the left-hand side and right-hand side tray channel.

Figure 37B:
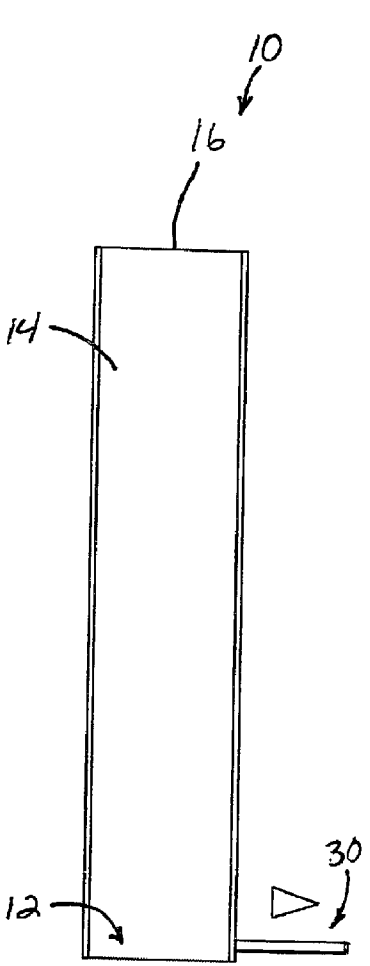
FIGS. 37A and 37B are side elevation views of the shelf of FIG. 36, in which the tray has been pulled through the shelf from the front and back of the shelf, respectively.
Figure 37A:
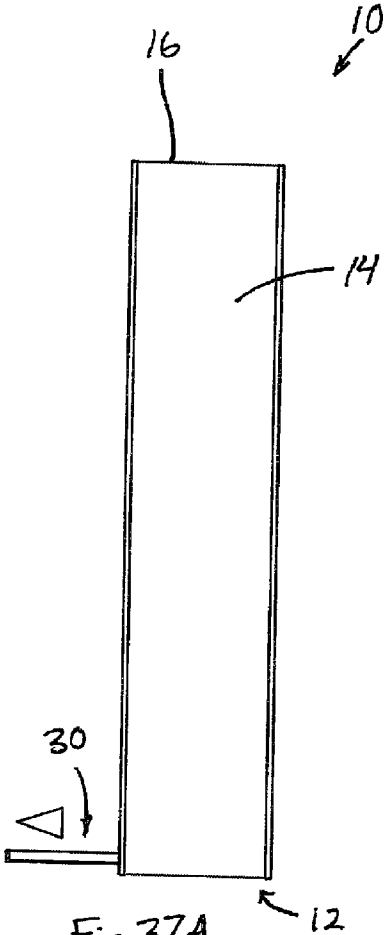
Figure 36:
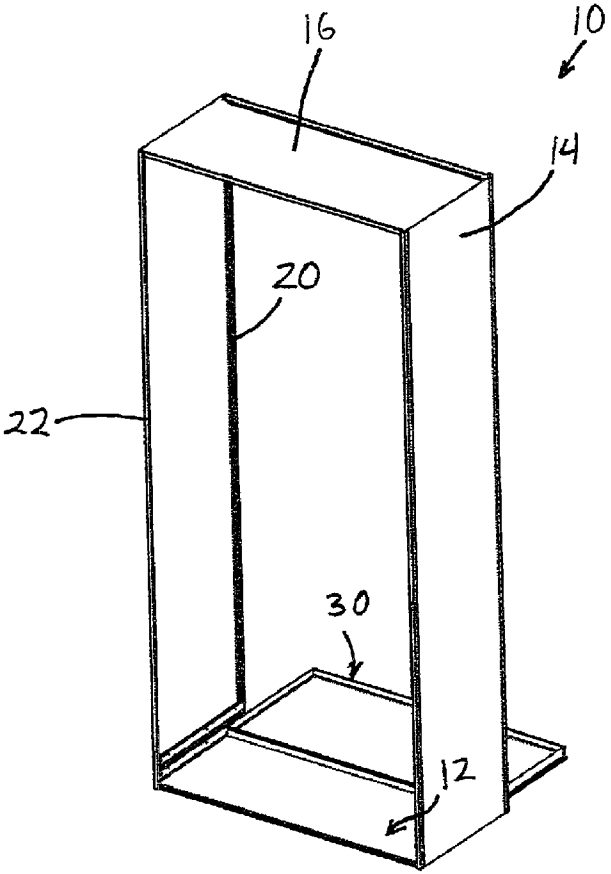
FIG. 36 is a perspective view of the shelf of FIG. 1 having several component removed for clarity.

Tray channel 28 supports a tray 30, which is illustrated in FIGS. 10-13, in shelf 10. In the illustrated embodiment shelf 10 comprises an open shelf with access through the front or the back of the shelf. Therefore, in the illustrated embodiment, tray channels 28 allow the tray to be pulled through the shelf from either the front or back of the shelf, such as shown in FIGS. 36-37B. As will be more fully described below, tray 30 includes an inert liner, which is particularly suitable for supporting or holding textiles, including clothing or fabric, which are sensitive to chemical impregnation, for example, from conventional plastics and other non-inert materials.

Tray 30 includes a weldment 32, which is shown in FIGS. 14-24, which supports liner 34. Weldment 32 is formed from a plurality of interconnected metal components, which provide support to liner 34 described in more detail in reference to FIGS. 10A-10C. In the illustrated embodiment, weldment 32 is formed from a plurality of side frame members 36, 38, and a plurality of cross-frame members 40, which interconnect frame members 36. Each member 36, 38 includes an inwardly extending lower leg or flange 36*a* and 38*a* with an upwardly extending flange or lip 36*b* and 38*b*, respectively. Side frame members 36 and 38 are interconnected to each other at their ends by weld tabs 42, which are formed on the web of side frame members 36 and which nest into notches formed in the vertical webs 38*c* of side frame members 38. In this manner, members 36 and 38 have a flush connection. Similarly, upwardly extending flanges 36*b* of members 36 are notched to receive channel members 40, which are secured in place, for example, by welding, such as spot welding. In addition, members 38 include inwardly projecting flanges 44 spaced above flanges 38*a*, which provide support to the liner, more fully described below.

To support tray 30 on tray channels 28, each member 38 also includes an outwardly projecting lower flange 46 on which plastic strips 48, which form tray runners, are mounted, for example by a clip or snap-fit connection. As best seen in FIG. 11, plastic strips 48 project outwardly from either side of the tray 30 for slidingly supporting tray 30 in tray channels 28. Referring again to FIGS. 7-9, tray channels 28 includes a channel-shaped member 50 with a flange provided by an angle member 52, which is secured to the web of member 50, for example by welding. Channel-shaped member 50 mounts to the respective vertical rails 20, 22 in shelf 10 by a pair of brackets 54. Each bracket 54 includes a channel-shaped member 56 in which channel-shaped member 50 is secured, for example by welding, and a flange 58, which includes a pair of locking pins 60 with enlarged heads 62 for engagement in openings 24 of the respective webs 26 of vertical rails 20 and 22 as will be understood by those skilled in the art.

As best understood from FIG. 9, the outwardly projecting leg 52*a* of angle 52 forms a guide track 64 between leg 52*a* and lower flange 50*a* of channel-shaped member 50. Guide track 64 receives plastic runners 48 of tray 30 to thereby slidingly support tray 30 in tray channels 28. Further, track 64 is free of obstruction throughout the entire length of tray channel 28 to thereby permit the tray to be pulled in either direction in track 64 and further pulled from either end of tray channel 28.

Figure 14:
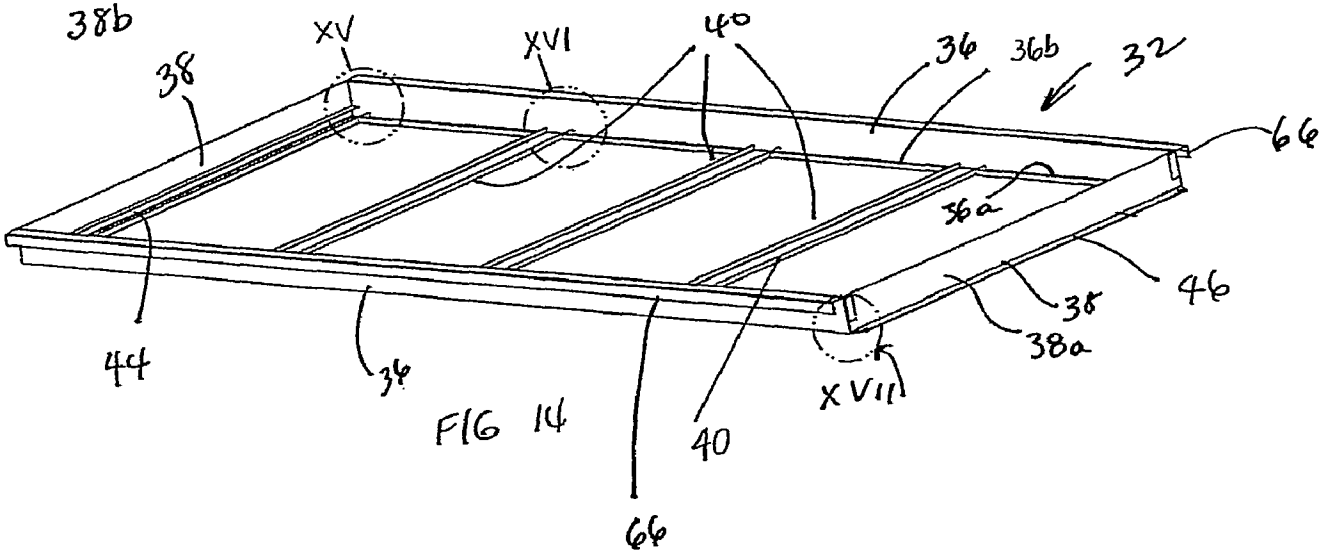
FIG. 14 is a perspective view of the weldement of the tray of FIGS. 10-13.
Figures 18, 19, 20, 21, 22, 23:
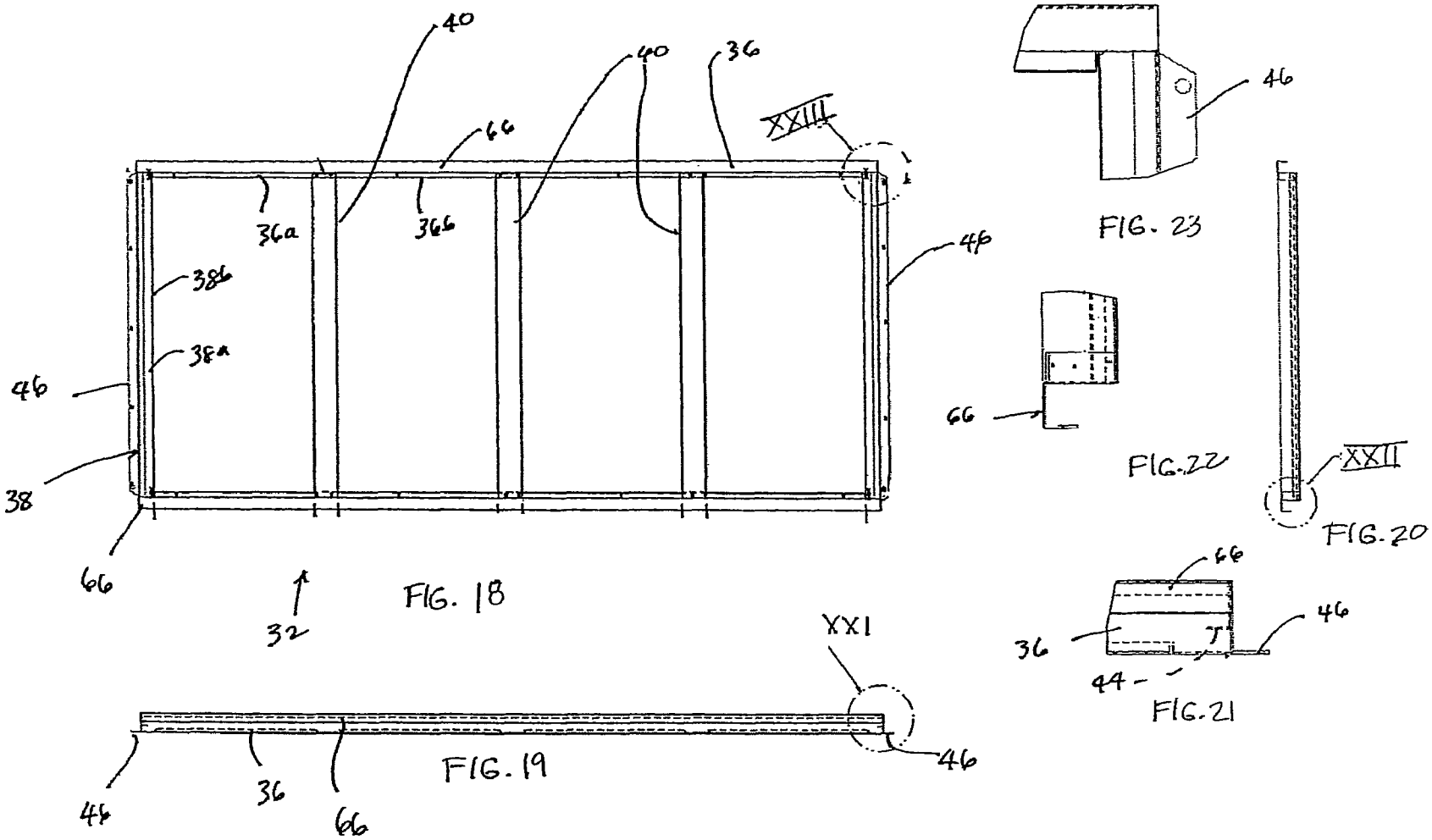
FIG. 18 is a plan view of the weldement of FIG. 14.
FIG. 19 is a front elevation view of the weldement of FIG. 18.
FIG. 20 is a side elevation view of the weldement of FIG. 18.
FIG. 21 is an enlarged view of the detail XXI of FIG. 19.
FIG. 22 is an enlarged view of detail XXII of FIG. 20.
FIG. 23 is an enlarged view of detail XXIII of FIG. 18.

As best seen in FIGS. 10, 13, and 14, tray 30 includes handles 66 formed by the upper outwardly projecting flanges 66*a* of members 36. Flanges 66 are preferably hemmed or folded over at their distal ends to provide hand pulls for the front and back of tray 30. In this manner, tray 30 essentially has no front or back and instead is universal in its pull direction. Therefore, when mounted in an open shelf, such as illustrated in FIG. 1, tray 30 can be extended from either the front or the back of the shelf.

Figure 10B:
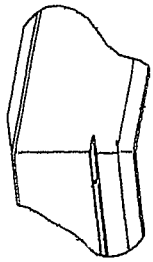
FIG. 10B is an enlarged view of detail XB of FIG. 10.
Figure 10C:
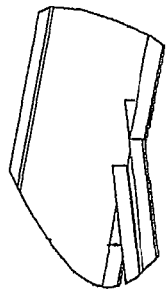
FIG. 10C is an enlarged view of detail XC of FIG. 10.
Figure 10A:
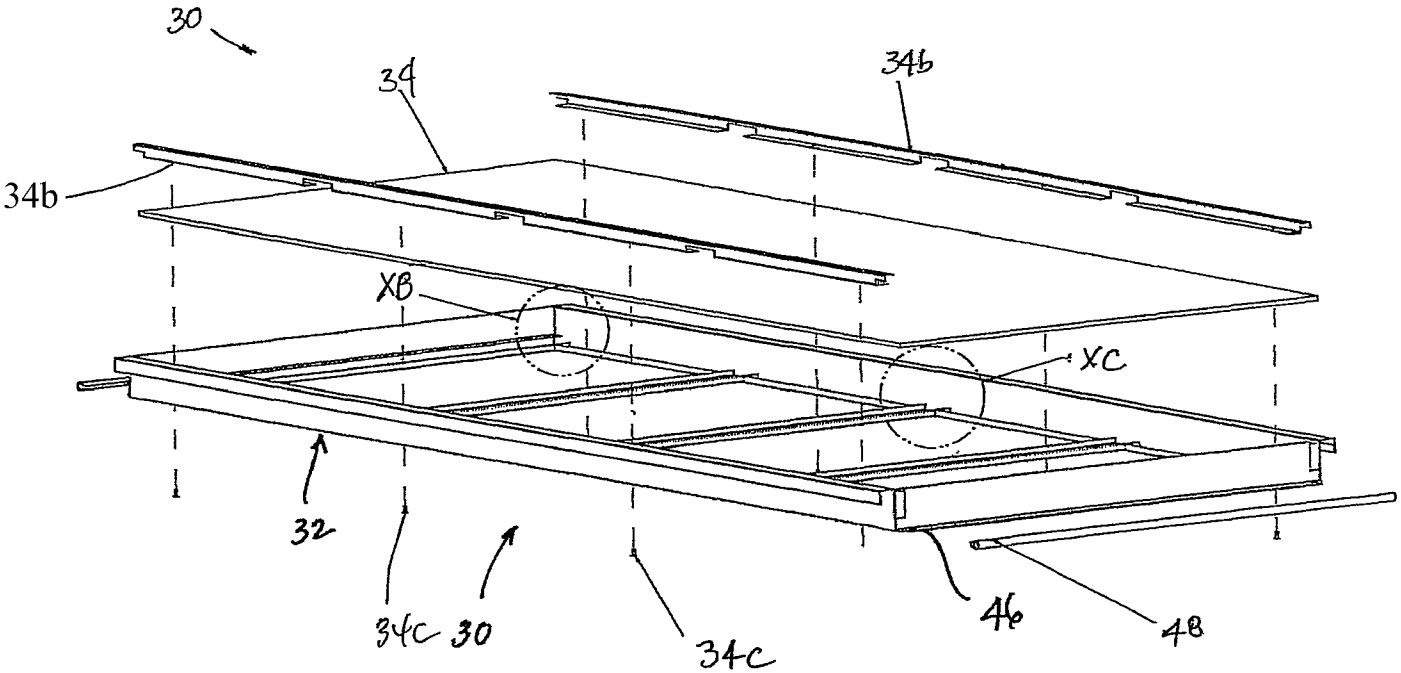
FIG. 10A is an exploded perspective view of the tray of FIG. 10.
Figure 17:
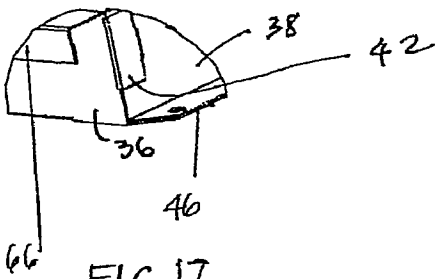
FIG. 17 is an enlarged view of the detail XVII of FIG. 14.
Figure 16:
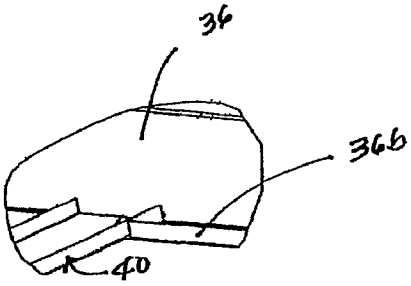
FIG. 16 is an enlarged view of detail XVI of FIG. 14.
Figure 15:
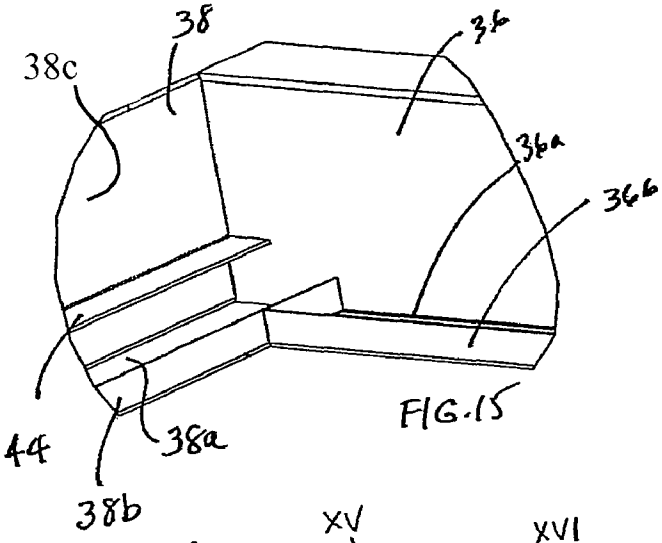
FIG. 15 is an enlarged view of detail XV of FIG. 14.

As best seen in FIGS. 10A-10C, liner 34 is formed from a sheet 34*a* of inert material. For example, sheet 34*a* may comprise an inert plastic, such as a high impact polypropylene copolymer. A suitable material is available under the trademark COROPLAST, which is an extruded twin wall plastic sheet formed from a high impact polypropylene copolymer with a NILH pH factor. Sheet 34*a* rests on the top edges of channels 40 and on the top edges of the flanges 36*b* and 38*b* of frame members 36 and 38. Further, sheet 34*a* extends between flanges 44 and flanges 38*b*, which thereby form a guide for sheet 34*a*. Further, once positioned between flanges 44 and flanges 38*b*, sheet 34*a* is secured in place by a pair of angle members 34*b*. Angle members 34*b* have their horizontal flanges and a portion of the vertical flanges notched to straddle channel members 40. Angle members 34*b* are then secured to frame members 36 by fasteners 34*c*, such as rivets, screws or the like, which extend through lower flanges 36*a* of members 36.

Referring to FIGS. 24A, 24B, and 25-29, shelf 10 may optionally include a textile drawer 70, which allows fabrics to be suspended in the shelving. Drawer 70 includes an outer perimeter frame 72, which is similarly formed from rigid members 74, 76. In the illustrated embodiment each member 74, 76 includes an inwardly extending lower flange 74*a* and 76*a* and an outwardly extending upper flange 74*b* and 76*b*. Flanges 76*b* include a downwardly depending portion or leg 76*c* to thereby form handles for drawer 70. Upper flanges 74*b* provide support and, further, provide cooperative structures that define discrete locations for one or more hangers 78, which may be mounted between members 74 and allow fabrics to be suspended from drawer 70. As would be understood, therefore, members 74 and 76 form an open, bottomless frame that allows fabrics to be suspended through the frame by hangers 78.

Figure 25:
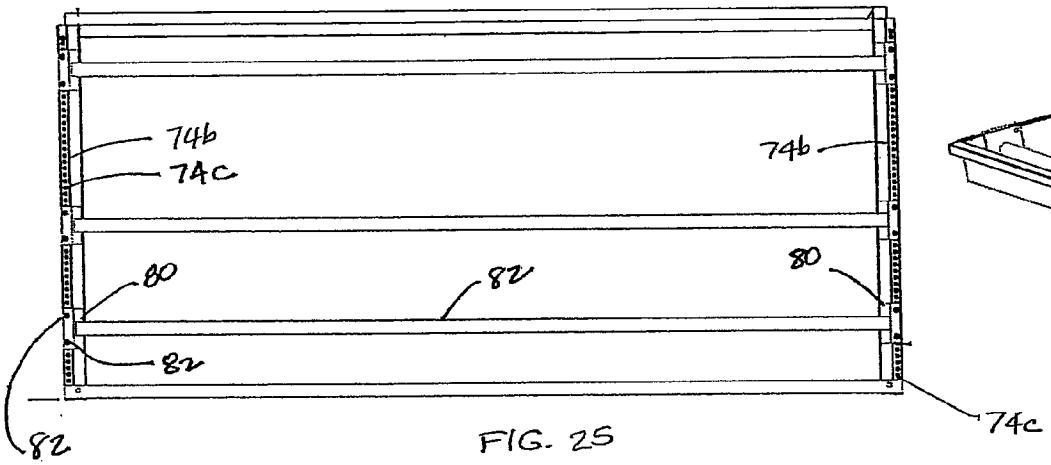
FIG. 25 is a top plan view of the drawer of FIG. 24A.
Figure 26:
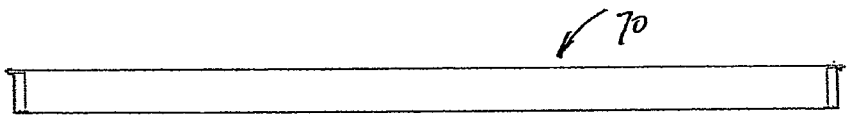
FIG. 26 is a front elevation view of the drawer of FIG. 24A.

As best seen in FIGS. 25, upper flanges 74*b* include a plurality of openings 74*c*, which form a plurality of defined discrete positions for hangers 78. Each hanger 78 includes a pair of brackets 80 and a rod 82, which is suspended between the respective brackets 80. Brackets 80 each include at least one projecting structure 80*a*, such as a pin for positioning in openings 74*c* to thereby fix the position of hanger 78 along the longitudinal axis of angle members 74. In this manner, the position of hangers 78 may be adjusted but also secured in place when the respective pins of the brackets are located in the openings of angle member 74 and engaged with the upper flanges 74*b* of angle members 74.

Figure 24A:
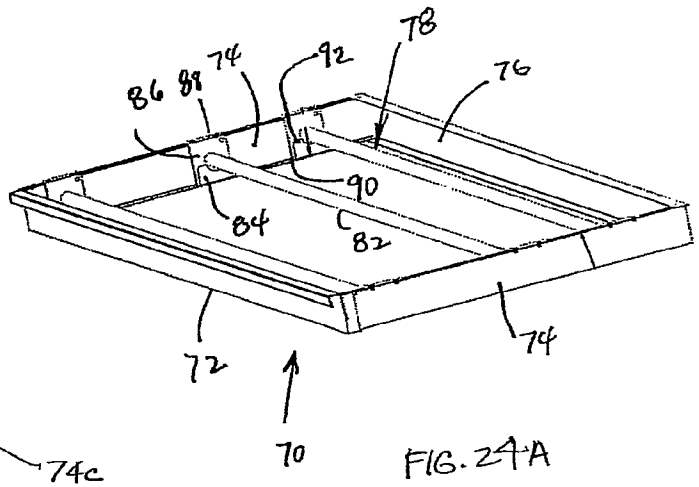
FIG. 24A is a perspective view of a drawer of the present invention.
Figure 24B:
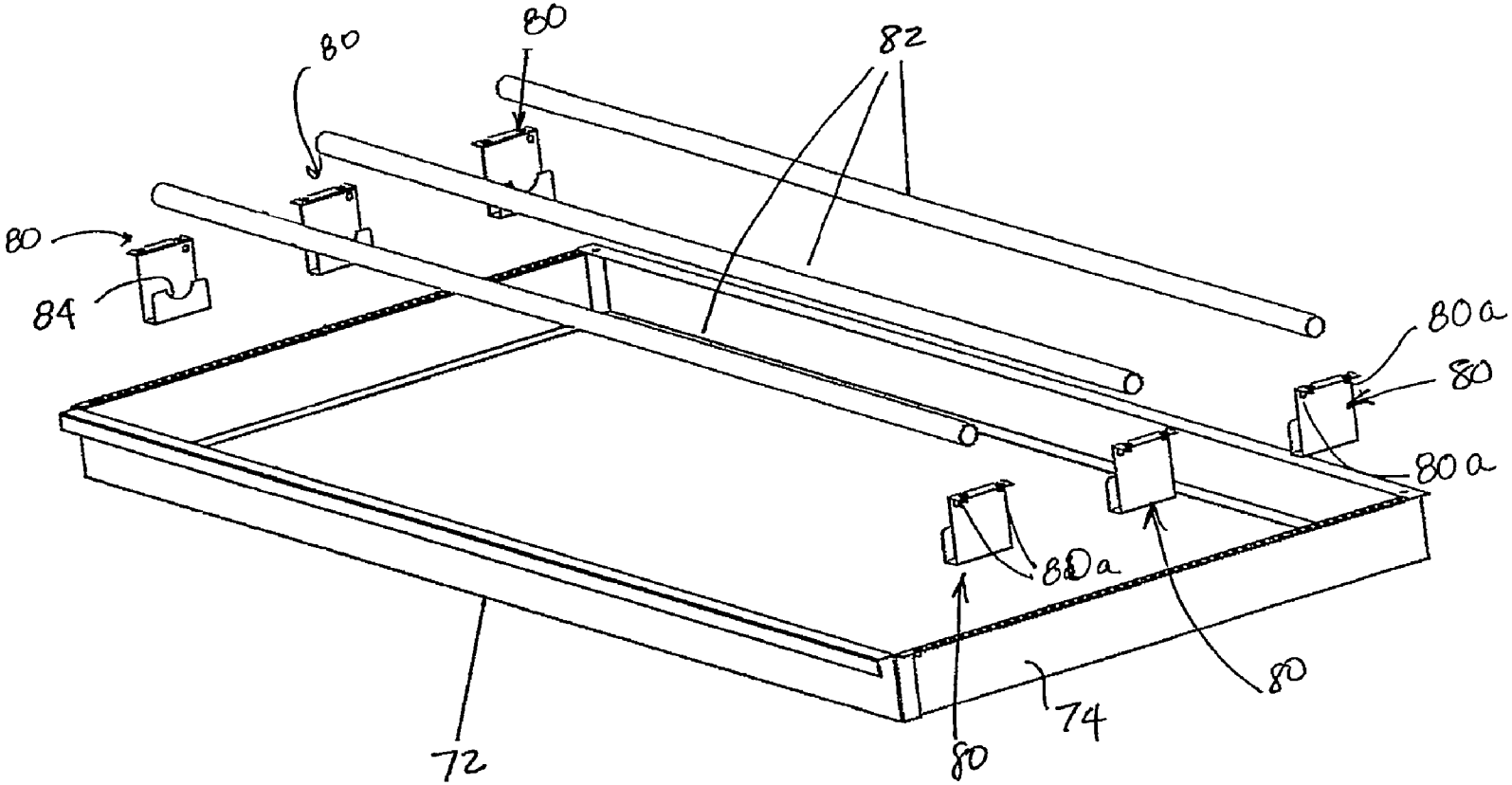
FIG. 24B is an exploded perspective view of the drawer of FIG. 24A.
Figure 27:
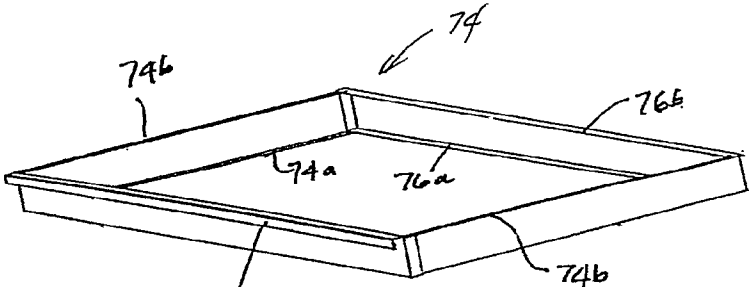
FIG. 27 is a perspective view of the frame of the drawer of FIG. 24A.
Figure 28:
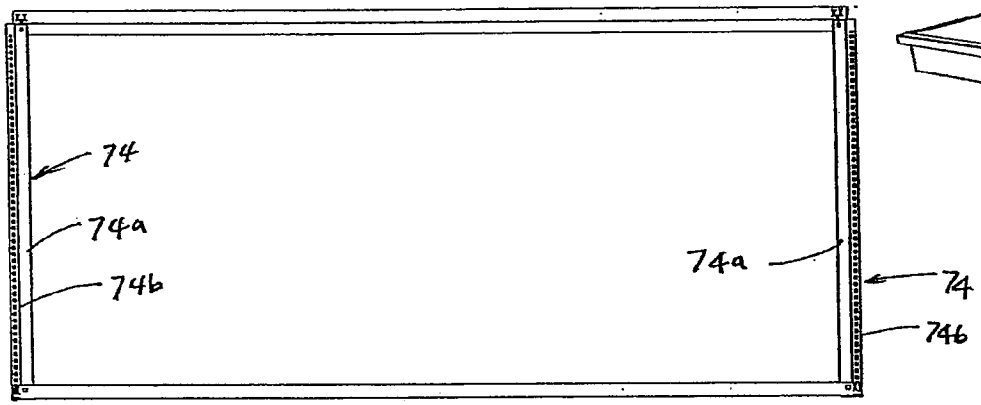
FIG. 28 is a similar view to FIG. 25 with the brackets and rods removed for clarity.
Figure 29:
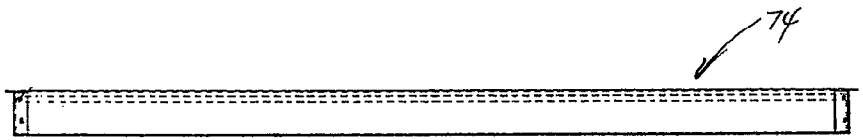
FIG. 29 is a front elevation view of the frame of FIG. 28.

As best seen in FIGS. 24A and 24B, rods 82 are supported by a cradle 84 formed by brackets 80. In this illustrated embodiment, brackets 80 comprise channel-shaped members with a vertical web 86 and an upper horizontal flange 88, which includes pins 80*a*, and a lower flange 90, which rests on flanges 74*a* of members 74. Lower flange 90 includes an upwardly turned flange or lip 92, which includes a notch to form the cradle for the respective rods. In this manner, the rods may be removed from the brackets to facilitate handling of the fabric that is draped over the respective rods.

Figure 30:
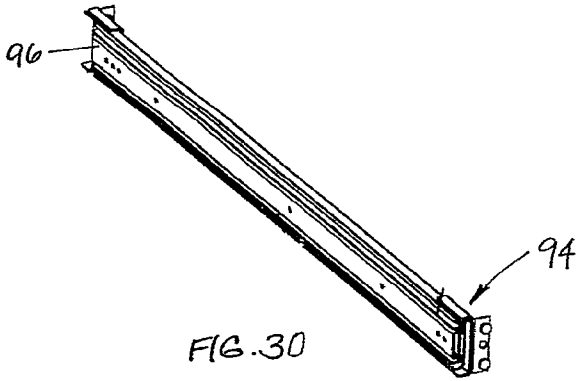
FIG. 30 is a perspective view of a slide rail for supporting the drawer of FIG. 24.
Figure 32:
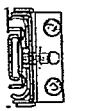
FIG. 32 is an end elevation view of the side rail of FIG. 31.
Figure 31:
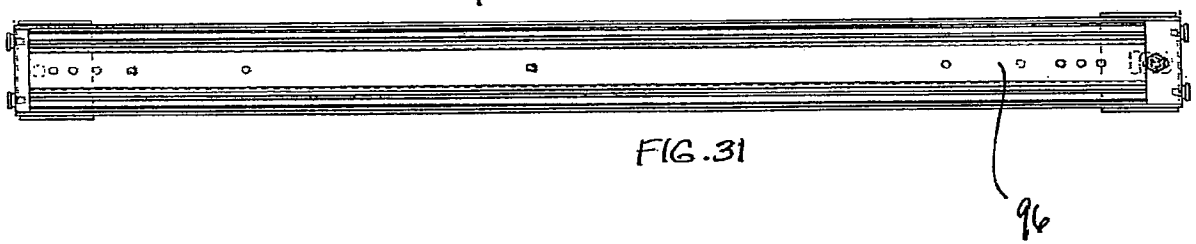
FIG. 31 is a front elevation view of the slide rail of FIG. 30.
Figure 30A:
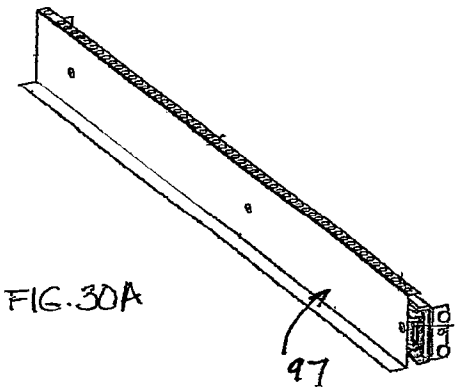
FIG. 30A is a similar view to FIG. 30 with a drawer mounting bracket shown mounted to the rail.
Figure 30B:
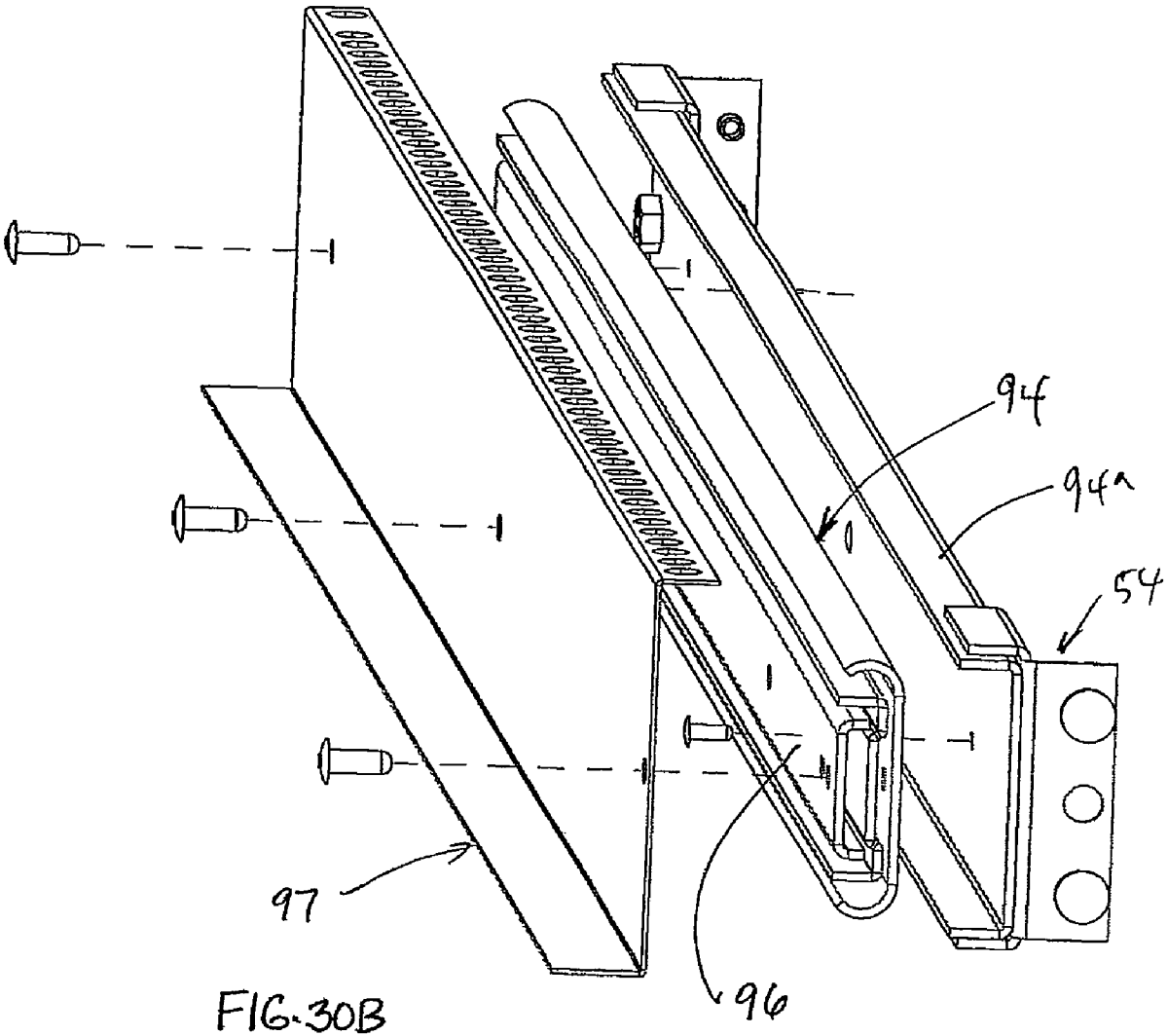
FIG. 30B is an enlarged perspective view of the rail and bracket of FIG. 30A.

Drawer 70 is mounted in shelving 10 by an extendable rail 94. A suitable extendable rail is illustrated in FIGS. 30-32. Rail 94 is commercially available from Accuride of Calif. and includes a plurality of nesting channel members that are supported for horizontal movement on bearings, including an inner-most channel-shaped member 96 to which drawer 70 is mounted by a bracket 97, which mounts to the side of drawer frame 72 by fasteners and to channel-shaped member 96 by fasteners. Rail 94 is mounted between the sides or panels of shelf 10 by a channel-shaped member 94*a*, which in turn is mounted in vertical rails 20, 22 by brackets 54 described previously.

Figure 33:
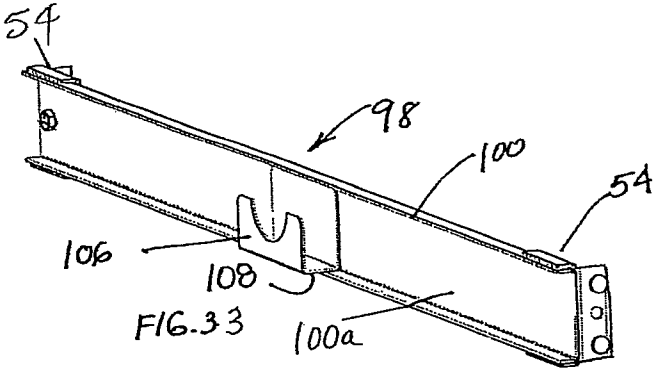
FIG. 33 is a perspective view of a hanger rod support of the present invention.
Figure 35:
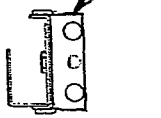
FIG. 35 is an end elevation view of the support of FIG. 34.
Figure 34:
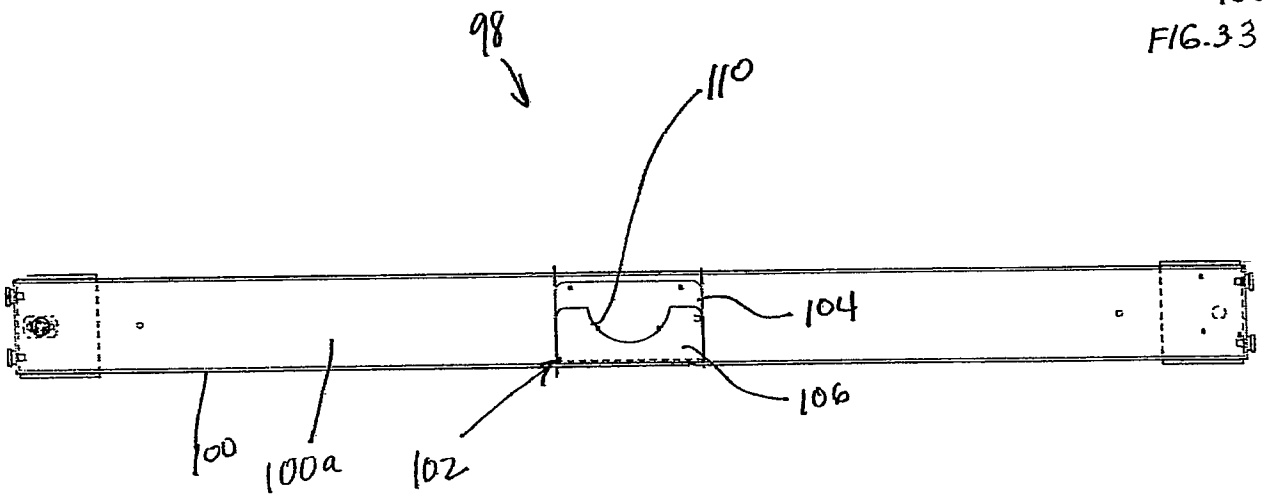
FIG. 34 is a front elevation view of the support of FIG. 33.

Referring to FIGS. 33-35, the numeral 98 designates yet another component that may be mounted in shelf 10. Component 98 forms a hanger rod support so that a rod may be suspended between the panels or sides of the shelf for supporting clothing in shelf 10. As best seen in FIG. 33, hanger rod support 98 includes a channel-shaped member 100, which is mounted between the respective panels of shelf 10 by brackets 54, which have been previously described in reference to tray channels 28. Channel-shaped member 100 provides a mounting surface for a second channel member 102, which includes a vertical leg or flange 104, which is secured to web 100*a* of channel 100, and a second vertical flange or leg 106. Flange 106 is spaced from flange 104 by a horizontal flange 108 and includes a recess 110 for receiving the end portion of a hanger rod. As will be understood, hanger rod supports 98 are mounted in pairs in shelf 10 to provide support for both ends of a hanger rod.

While several forms of the invention have been shown and described, other forms will now be apparent to those skilled in the art. For example, in preferred form, the frame members and mounting hardware are all preferably formed from metal, and preferably a light weight metal. However, it should be appreciated that other materials may be used. Further as noted, while the various components of the present invention are illustrated as being mounted in a stationary shelf, they may be used in other applications, including a shelving system, such as a movable shelf system of the type available from Borroughs Corporation. Therefore, it will be understood that the embodiments shown in the drawings and described above are merely for illustrative purposes, and are not intended to limit the scope of the invention.

We claim:

1. A tray for a storage system, said tray comprising:

a pair of first side frame members, a pair of second side frame members, and at least one cross frame member, said cross frame member and said second side frame members disposed between and interconnecting said first side frame members to thereby form a frame, each of said first and second side frame members including an inwardly extending lower flange, and each of said second side frame members including an inwardly projecting flange spaced upwardly from said inwardly extending lower flanges;

an inert liner removably supported by said cross frame member and said first and second side frame members and inserted between said inwardly projecting flanges and said inwardly extending lower flanges of said second side frame members; and at least one angle member configured to secure said inert liner to said frame, said angle member being securable to said frame via at least one fastener, wherein each of said inwardly extending lower flanges of said first side frame members includes an upwardly extending lip, said lips including a plurality of notches, and said cross frame member being located in said notches.

2. The tray according to claim 1, wherein said at least one cross frame member comprises a channel-shaped member with upwardly extending flanges each with an upper edge, each of said upwardly extending lips of said first side frame members including an upper edge, said notches sized to position said cross frame member such that the upper edges of said cross frame member are generally coplanar with the upper edges of said upwardly extending lips of said first side frame members, and wherein said liner is supported on said upper edges of said lips and said upper edges of said cross frame member.

3. The tray according to claim 1, wherein said liner comprises an inert plastic sheet, said sheet resting on said cross frame member and said inwardly extending lower flanges of said side frame members.

4. The tray according to claim 1, wherein said liner comprises an extruded twin wall sheet.

5. The tray according to claim 4, wherein said sheet comprises a high impact polypropylene copolymer.

6. The tray according to claim 1, further in combination with a tray support having a pair of rails providing unrestricted sliding movement of said tray relative to said rails, wherein said tray may be moved relative to said rails in opposed directions to permit said tray to be removed or inserted into said tray support from either side of said tray support.

7. The tray according to claim 6, wherein said frame comprises guides for sliding engagement with said pair of rails.

8. A storage system comprising:

a pair of rails, each of said rails comprising a channel-shaped member, each of said channel-shaped members including an upper flange, a lower flange, and an intermediate flange, said intermediate flange and said lower flange defining a track therebetween;

a tray, said tray including a frame and an inert liner removably supported in said frame, and said frame including guides for sliding engagement with said tracks of said rails, a pair of first side frame members, a pair of second side frame members, and at least one cross frame member;

said cross frame member and said second side frame members being disposed between and interconnecting said first side frame members to thereby form said frame, each of said first and second side frame members including an inwardly extending lower flange, and each of said second side frame members including an inwardly projecting flange spaced upwardly from said inwardly extending lower flanges;

said inert liner being removably supported by said cross frame member and said first and second side frame members and inserted between said inwardly projecting flanges and said inwardly extending lower flanges of said second side frame members;

at least one angle member configured to secure said inert liner to said frame, said angle member being securable to said frame via at least one fastener;

wherein said pair of rails provide unrestricted sliding movement of said tray relative to said rails wherein said tray may be moved relative to said rails in opposed directions to permit said tray to be removed or inserted into the storage system from either side of the storage system.

9. The storage system according to claim 8, wherein said inert liner comprises an inert plastic liner.

10. The storage system according to claim 8, further comprising a pair of panels, and one or more braces that interconnect said panels, said rails extending along said panels and providing support for said guides of said tray, and said rails permitting said tray to move between said panels.

11. The storage system according to claim 8, wherein said cross frame member comprises a pair of channel-shaped members, said inwardly extending lower flanges of said first side frame members having an upwardly extending lip with a plurality of notches, each of said upwardly extending lips and said channel-shaped members having an upper edge, said notches being configured to receive said cross frame members such that said upper edges of the cross frame members are generally coplanar with said upper edges of said upwardly extending lips.

12. The storage system according to claim 8, wherein said guides comprise outwardly projecting flanges extending from opposed sides of said tray, further comprising a plastic strip mounted to each of said outwardly projecting lower flanges to thereby form tray runners.

13. The storage system according to claim 8, wherein said storage system comprises a pair of panels and at least one brace interconnecting said panels, and said rails extending along said panels.

14. The storage system according to claim 8, further comprising:

a second pair of rails;

a drawer, said drawer supported by said second pair of rails, said drawer comprising an open frame, said open frame including a pair of opposed side frame members, each of said side frame members having a plurality of cooperative structures defining a plurality of discrete locations; and at least one hanger mounted between said side frame members at one of said discrete locations, said hanger being removably mounted at one of said discrete locations wherein said hanger may be removed from said frame to facilitate handling of a fabric that may be draped over the respective hanger.

15. The storage system according to claim 14, wherein said hanger includes a rod and a pair of brackets, said brackets supporting said rod, said brackets releasably engaging said opposed side frame members at said discrete locations to permit said brackets and said rod to be moved to another discrete location along said side frame members.

16. The storage system according to claim 14, wherein said cooperative structures comprise recesses.

17. The storage system according to claim 16, wherein each of said side frame members includes an upper flange, said upper flanges including said plurality of cooperative structures.

18. The storage system according to claim 17, wherein said cooperative structures comprise openings through said flanges, said openings forming said recesses.

19. The storage system according to claim 18, wherein said hanger includes a rod and a pair of brackets, said brackets supporting said rod, and wherein said brackets include a pair of structures for engaging two of said openings to thereby fix the position of the brackets along said flanges of said opposed side frame members.

20. The storage system according to claim 19, wherein each of said side frame members includes an inwardly projecting lip for supporting said brackets.

21. The storage system according to claim 19, wherein each of said brackets includes a cradle for supporting a respective end of said rod wherein said rod can be removed from said brackets.

22. A tray for a storage system, said tray comprising:

a pair of first side frame members, a pair of second side frame members, and at least one cross frame member, said cross frame member and said second side frame members disposed between and interconnecting said first side frame members to thereby form a frame, each of said first and second side frame members including an inwardly extending lower flange, and each of said second side frame members including an inwardly projecting flange spaced upwardly from said inwardly extending lower flanges;

an inert liner removably supported by said cross frame member and said first and second side frame members and inserted between said inwardly projecting flanges and said inwardly extending lower flanges of said second side frame members; and at least one angle member configured to secure said inert liner to said frame, said angle member being securable to said frame via at least one fastener, further in combination with a tray support having a pair of rails providing unrestricted sliding movement of said tray relative to said rails, wherein said tray may be moved relative to said rails in opposed directions to permit said tray to be removed or inserted into said tray support from either side of said tray support.

* * * * *